US009063452B2

(12) United States Patent
Hagiwara et al.

(10) Patent No.: US 9,063,452 B2
(45) Date of Patent: Jun. 23, 2015

(54) IMAGE FORMING APPARATUS WITH DECREMENT RATIO BETWEEN CHARGING ROLLER AND PHOTOCONDUCTOR DRUM

(71) Applicant: FUJI XEROX CO., LTD., Minato-ku, Tokyo (JP)

(72) Inventors: Takuro Hagiwara, Kanagawa (JP); Yoshiki Shimodaira, Kanagawa (JP); Yuko Kawase, Kanagawa (JP); Satoru Tsuto, Kanagawa (JP); Minoru Rokutan, Kanagawa (JP); Satoya Sugiura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/041,898

(22) Filed: Sep. 30, 2013

(65) Prior Publication Data

US 2014/0219680 A1 Aug. 7, 2014

(30) Foreign Application Priority Data

Feb. 7, 2013 (JP) ..... 2013-021952

(51) Int. Cl.
*G03G 15/00* (2006.01)
*G03G 15/02* (2006.01)

(52) U.S. Cl.
CPC ..... *G03G 15/0216* (2013.01); *G03G 15/0233* (2013.01)

(58) Field of Classification Search
CPC ..... G03G 15/0233; G03G 15/0216
USPC ..... 399/159, 176
See application file for complete search history.

(56) References Cited

U.S. PATENT DOCUMENTS

2010/0104316 A1 4/2010 Hoshio et al.
2013/0064574 A1 * 3/2013 Suzumura et al. ..... 399/168

FOREIGN PATENT DOCUMENTS

JP 2004-037734 A 2/2004
JP 2011-007848 A 1/2011
JP 4666051 B2 4/2011

* cited by examiner

*Primary Examiner* — Billy Lactaoen
(74) *Attorney, Agent, or Firm* — Sughrue Mion, PLLC

(57) ABSTRACT

An image forming apparatus includes a charging roller including elastic and surface layers and a photoconductor drum. Initially, the surface layer has a surface roughness Rz of 3-6 μm, and the layers have an impedance ratio of 0.81 or less in absolute value at a frequency of 800-3000 Hz. After a predetermined time, the surface roughness Rz is reduced by a decrement ΔRz of 0.1-4 μm. The drum has a film thickness D initially ranging from 20-40 μm and reduced by a decrement ΔD of 5-25 μm after the predetermined time. Herein, $0.005 \leq \Delta Rz/\Delta D \leq 0.8$ holds. The impedance ratio is represented as ZE/(ZE+ZS) wherein ZE and ZS represent the respective impedances of the elastic layer and the surface layer, and 100k A4-size recording media recorded with images with an area coverage of 7% are printed in the predetermined time.

16 Claims, 6 Drawing Sheets

FIG. 7A

| | SURFACE LAYER | | | RESISTIVE ELASTIC LAYER | |
|---|---|---|---|---|---|
| | FILLER DIAMETER (μm) | FILLER AMOUNT (wt%) | LEVELING AGENT (%) | CARBON AMOUNT (wt%) | POLYMER TYPE |
| EMBODIMENT EXAMPLE | 5 | 10 | 1 | 6 | T3108 |
| COMPARATIVE EXAMPLE | 5 | 40 | 1 | 6 | T3106 |

FIG. 7B

| | RE (Ω) | CE (F) | RS (Ω) | CS (F) | Rz (μm) |
|---|---|---|---|---|---|
| EMBODIMENT EXAMPLE | 6.00E+04 | 3.50E−10 | 3.60E+06 | 2.20E−09 | 4.8 |
| COMPARATIVE EXAMPLE | 1.40E+05 | 3.50E−10 | 1.60E+09 | 2.30E−09 | 10.4 |

IMAGE FORMING APPARATUS WITH DECREMENT RATIO BETWEEN CHARGING ROLLER AND PHOTOCONDUCTOR DRUM

CROSS-REFERENCE TO RELATED APPLICATIONS

This application is based on and claims priority under 35 USC 119 from Japanese Patent Application No. 2013-021952 filed Feb. 7, 2013.

BACKGROUND

Technical Field

The present invention relates to an image forming apparatus.

SUMMARY

According to an aspect of the invention, there is provided an image forming apparatus including a charging roller and a photoconductor drum. The charging roller includes a resistive elastic layer and a surface layer formed thereon. At an initial stage after the start of an operation of the image forming apparatus, the surface layer has a ten-point average surface roughness Rz ranging from approximately 3 μm to approximately 6 μm, and the resistive elastic layer and the surface layer have an impedance ratio of approximately 0.81 or less in absolute value in a frequency range from approximately 800 Hz to approximately 3000 Hz. The ten-point average surface roughness Rz of the surface layer is reduced by a decrement ΔRz ranging from approximately 0.1 μm to approximately 4 μm after the lapse of a predetermined time. The photoconductor drum has a film thickness D ranging from approximately 20 μm to approximately 40 μm at the initial stage after the start of the operation, and reduced by a decrement ΔD ranging from approximately 5 μm to approximately 25 μm after the lapse of the predetermined time. Herein, the relationship "$0.005 \leq \Delta Rz/\Delta D \leq 0.8$" holds. The impedance ratio is represented as ZE/(ZE+ZS) in which ZE and ZS represent the impedance of the resistive elastic layer and the impedance of the surface layer, respectively. The predetermined time corresponds to a time taken to print 100k A4-size recording media recorded with images with an area coverage of approximately 7%.

BRIEF DESCRIPTION OF THE DRAWINGS

An exemplary embodiment of the present invention will be described in detail based on the following figures, wherein:

FIG. 7A is a diagram illustrating basic formulations of an embodiment example and a comparative example, and FIG. 7B is a diagram illustrating impedance measurement results and values of ten-point average surface roughness Rz of the respective examples.

DETAILED DESCRIPTION

Figure 1:
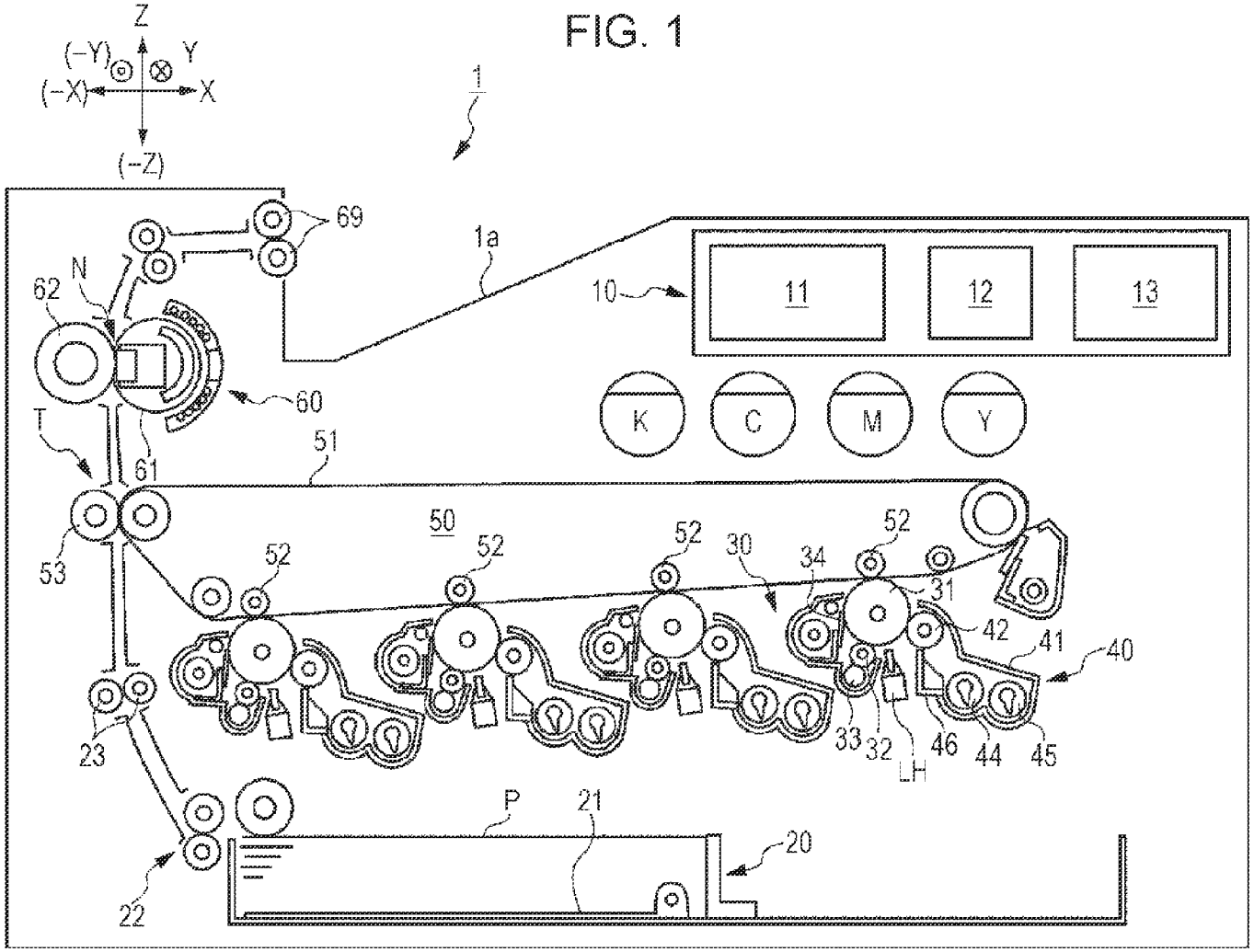
FIG. 1 is a schematic cross-sectional view illustrating an example of a schematic configuration of an image forming apparatus.

Referring to the drawings, the present invention will now be described in more detail with reference to an exemplary embodiment and a specific example given below. The present invention, however, is not limited to the exemplary embodiment and the specific example. Further, it is to be noted in the following description referring to the drawings that the drawings are schematic and dimensional ratios and so forth are different from actual ones. The illustration of members other than those necessary for the description to facilitate understanding is omitted as appropriate.

(1) Overall Configuration and Operation of Image Forming Apparatus

FIG. 1 is a schematic cross-sectional view illustrating an internal configuration of an image forming apparatus 1 according to the present exemplary embodiment. With reference to the drawing, the overall configuration and operation of the image forming apparatus 1 will be described below.

The image forming apparatus 1 includes a controlling device 10, a sheet feeding device 20, photoconductor units 30, developing devices 40, a transfer device 50, and a fixing device 60. An upper surface of the image forming apparatus 1 (in the Z direction) is formed with a discharge stacking unit 1*a* to which an image-recorded sheet is discharged to be stored therein.

The controlling device 10 includes a controller 11 that controls the operation of the image forming apparatus 1, an image processing unit 12 controlled in operation by the controller 11, a power supply device 13, and so forth. The power supply device 13 applies voltages to charging rollers 32, developing rollers 42, first transfer rollers 52, a second transfer roller 53, and so forth, which will be described later. The image processing unit 12 converts print information input from an external information transmitting apparatus (a personal computer or the like, for example) into image information for forming a latent image, and outputs driving signals to exposure devices LH with preset timing. Each of the exposure devices LH of the present exemplary embodiment is formed by an LED head including linearly arranged light emitting diodes (LEDs).

The sheet feeding device 20 is provided in a bottom portion of the image forming apparatus 1. The sheet feeding device 20 includes a sheet stacking plate 21, and a multitude of sheets P serving as recording media are stacked on the upper surface of the sheet stacking plate 21. The sheets P stacked on the sheet stacking plate 21 and positioned in the width direction by regulating plates (not illustrated) are extracted forward (in the −X direction) one by one from the top by a sheet extracting unit 22, and thereafter are transported to a nip part of a registration roller pair 23.

The photoconductor units 30 are aligned above the sheet feeding device 20 (in the Z direction), and each include a photoconductor drum 31 serving as an image carrier that is driven to rotate. The charging roller 32, the exposure device LH, the developing device 40, the first transfer roller 52, and a cleaning blade 34 are disposed along the rotation direction of the photoconductor drum 31. A cleaning roller 33 that cleans a surface of the charging roller 32 is disposed facing and in contact with the charging roller 32.

The developing device 40 includes a developing housing 41 that stores a developer. The developing housing 41 houses the developing roller 42 disposed facing the photoconductor drum 31 and a pair of augers 44 and 45 disposed obliquely below the developing roller 42 to stir and transport the developer toward the developing roller 42. A layer regulating member 46 that regulates the layer thickness of the developer is disposed in the proximity of the developing roller 42. The developing devices 40 are configured substantially similarly except for the developers stored in the developing housings 41, and respectively form toner images of yellow (Y), magenta (M), cyan (C), and black (K) colors.

A surface of the rotating photoconductor drum 31 is charged by the charging roller 32, and an electrostatic latent image is formed thereon by latent image-forming light emitted from the exposure device LH. The electrostatic latent image formed on the photoconductor drum 31 is developed into a toner image by the developing roller 42.

The transfer device 50 includes an intermediate transfer belt 51 and the first transfer rollers 52. The toner images of the respective colors formed on the photoconductor drums 31 of the respective photoconductor units 30 are multiply transferred onto the intermediate transfer belt 51. The first transfer rollers 52 sequentially transfer (first-transfer) the toner images of the respective colors formed in the respective photoconductor units 30 onto the intermediate transfer belt 51. The transfer device 50 further includes the second transfer roller 53 that batch-transfers (second-transfers) the toner images of the respective colors transferred to the intermediate transfer belt 51 in a superimposing manner onto the sheet P serving as a recording medium.

The toner images of the respective colors formed on the photoconductor drums 31 of the respective photoconductor units 30 are sequentially electrostatically transferred (first-transferred) onto the intermediate transfer belt 51 by the first transfer rollers 52 applied with a predetermined transfer voltage by, for example, the power supply device 13 controlled by the controller 11. Thereby, superimposed toner images are formed in which toners of the respective colors are superimposed on one another.

In accordance with the movement of the intermediate transfer belt 51, the superimposed toner images on the intermediate transfer belt 51 are transported to a region in which the second transfer roller 53 is disposed (a second transfer part T). The sheet P is supplied to the second transfer part T from the sheet feeding device 20 in proper timing with the transport of the superimposed toner images to the second transfer part T. Then, the second transfer roller 53 is applied with a predetermined transfer voltage by, for example, the power supply device 13 controlled by the controller 11, and the multiple toner images on the intermediate transfer belt 51 are batch-transferred onto the sheet P fed from the registration roller pair 23 and guided by transport guides.

Residual toners on the surfaces of the photoconductor drums 31 are removed by the cleaning blades 34 and collected in a waste toner container (not illustrated). The surfaces of the photoconductor drums 31 are recharged by the charging rollers 32. Deposits adhering to the charging rollers 32 without being removed by the cleaning blades 34 are captured by surfaces of the cleaning rollers 33 that rotate while in contact with the charging rollers 32.

The fixing device 60 includes an endless fixing belt 61 that rotates in one direction and a pressure roller 62 that is in contact with a circumferential surface of the fixing belt 61 and rotates in one direction. A nip part N (a fixing area) is formed by a region in which the fixing belt 61 and the pressure roller 62 are in contact with each other with pressure. The sheet P having the toner image transferred thereto in the transfer device 50 but not fixed thereon is transported to the fixing device 60 via transport guides. The sheet P transported to the fixing device 60 is subjected to pressure and heat applied by the fixing belt 61 and the pressure roller 62 forming a pair. Thereby, the toner image is fixed on the sheet P. The sheet P formed with the fixed toner image is guided by transport guides and discharged through a discharge roller pair 69 to the discharge stacking unit 1*a* on the upper surface of the image forming apparatus 1.

Figure 2:
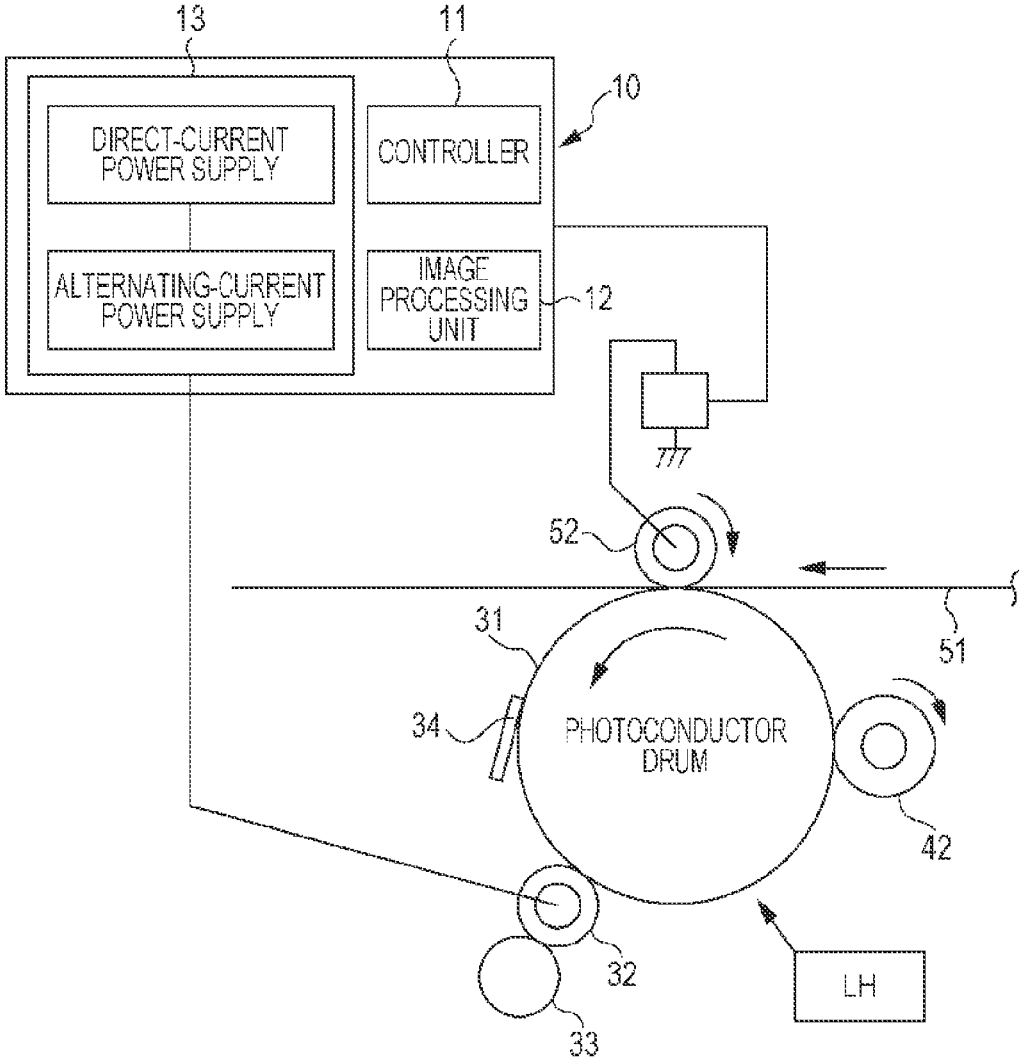
FIG. 2 is a schematic diagram for describing a function of an image forming unit of the image forming apparatus.

(2) Configuration and Operation of Image Forming Unit (2.1) Configuration of Image Forming Unit FIG. 2 is a schematic diagram for describing in more detail a function of an image forming unit including the controlling device 10, the photoconductor units 30, the exposure devices LH, the developing devices 40, the transfer device 50, and so forth of the image forming apparatus 1 according to the present exemplary embodiment.

As illustrated in FIG. 2, in the image forming unit, the charging roller 32 is rotatably disposed in contact with the photoconductor drum 31, and the cleaning roller 33 is disposed facing and in contact with the charging roller 32. An exposure position of the exposure device LH is set downstream of the charging roller 32, and the developing roller 42 is disposed downstream of the exposure position to face the photoconductor drum 31. On the downstream side of the developing roller 42, the first transfer roller 52 is disposed in contact with the photoconductor drum 31 via the intermediate transfer belt 51, thereby forming a transfer part. On the downstream side of the transfer part and on the upstream side of the charging roller 32, the cleaning blade 34 is in elastic contact with the photoconductor drum 31.

The controlling device 10 includes the controller 11 that controls the operation of the image forming apparatus 1, the image processing unit 12 controlled in operation by the controller 11, the power supply device 13, and so forth. The power supply device 13 applies to the charging rollers 32 a superimposed voltage having a direct-current voltage (Vdc) and an alternating-current voltage (Vac) superimposed on each other, and applies necessary voltages to the developing rollers 42, the first transfer rollers 52, the second transfer roller 53, and so forth.

The image processing unit 12 converts print information input from an external information transmitting apparatus (a personal computer or the like, for example) into image information for forming a latent image, and outputs driving signals to the exposure devices LH with preset timing. Each of the exposure devices LH of the present exemplary embodiment is formed by an LED head including linearly arranged light emitting diodes (LEDs).

(2.2) Function of Image Forming Unit

In a contact charging system using the charging roller 32, the superimposed voltage for charging, in which a direct-current voltage (Vdc) and an alternating-current voltage (Vac) are superimposed on each other, is applied to the charging roller 32. If the charging roller 32 is applied only with the direct-current voltage (Vdc), current flows only in a low-resistance area on the photoconductor drum 31, and thus the photoconductor drum 31 fails to be uniformly charged. Further, if the surface of the photoconductor drum 31 is locally contaminated, an issue arises in that only contaminated portions fail to be charged. For this reason, the charging roller 32 is applied with the superimposed voltage having a direct-current voltage (Vdc) and an alternating-current voltage (Vac) superimposed on each other, to thereby charge the surface of the photoconductor drum 31.

Figure 3:
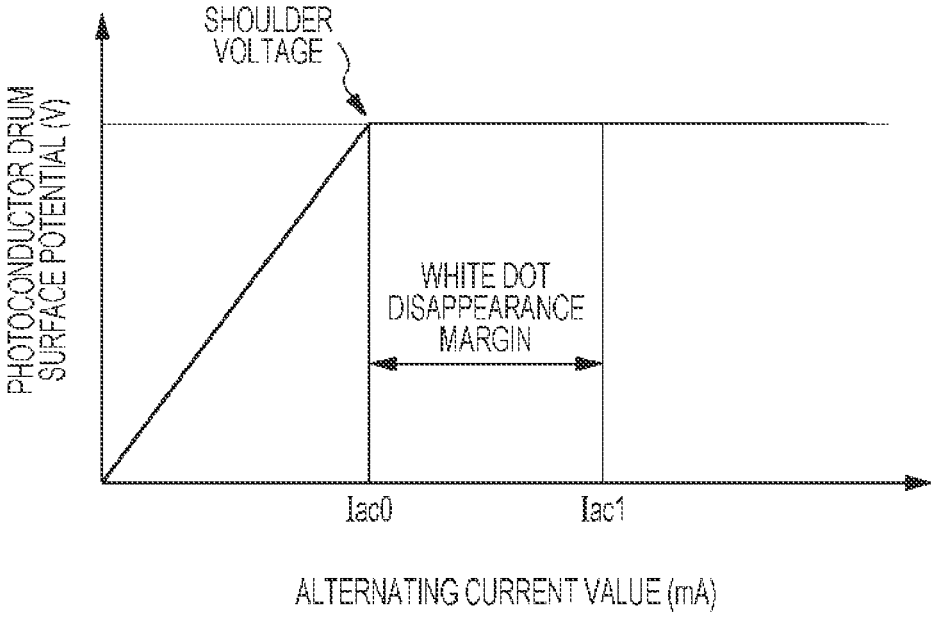
FIG. 3 is a diagram illustrating a shoulder voltage and the relationship between the value of alternating current supplied to a charging roller and the surface potential of a photoconductor drum.

Further, when the superimposed voltage having a predetermined direct-current voltage (Vdc) and a predetermined alternating-current voltage (Vac) superimposed on each other is applied to the charging roller 32 disposed in contact with the photoconductor drum 31 being driven to rotate, the surface potential of the photoconductor drum 31 does not exceed a certain voltage (shoulder voltage) (a saturation current value Iac0, see FIG. 3), even if the alternating-current voltage is applied with the amplitude thereof (voltage peak-to-peak: Vpp) increased to a predetermined value or higher.

Practically, the alternating current value is set to an alternating current value (Iac1) higher than the saturation current value (Iac0) by 10% to 25%, for example, in consideration of the image quality and environmental variation. If the alternating current value (Iac1) is excessively high, however, a trouble such as abrasion of the photoconductor drum 31 is caused. Conversely, if the alternating current value (Iac1) is excessively low, it is difficult to maintain charging uniformity, and an image defect such as white dots occurs particularly when image formation is performed under a low-temperature, low-humidity environment.

It is common to use the alternating current value (Iac1) set higher than the shoulder current value (Iac0) by a certain degree so as to suppress the white dots. If the amplitude (voltage peak-to-peak: Vpp) of the alternating-current voltage is gradually increased from the shoulder current value (Iac0), the white dots are gradually reduced and eventually disappear. The range from the shoulder current value (Iac0) to the alternating current value (Iac1) at which the white dots disappear is defined as a white dot disappearance margin.

Further, surface grinding of the charging roller 32 during the manufacturing process thereof has been performed to set the ten-point average surface roughness Rz of a surface layer 32*a* of the charging roller 32 in a range from 3 μm to 12 μm, to thereby suppress local abnormal discharge due to differences in height of irregularities of the surface layer 32*a* and reduce the image defect such as white dots. The ten-point average surface roughness Rz of the surface layer 32*a* is preferably in a range from 7 μm to 12 μm, more preferably in a range from 10 μm to 12 μm. With the ten-point average surface roughness Rz of the surface layer 32*a* set in such a range, foreign substances such as toner and additive are less likely to adhere to the surface layer 32*a*. As a result, the contamination resistance of the charging roller 32 is improved. If the ten-point average surface roughness Rz of the surface layer 32*a* is less than 3 μm, foreign substances such as toner and additive may adhere to the surface layer 32*a*. If the ten-point average surface roughness Rz of the surface layer 32*a* is more than 12 μm, toner, paper dust, and so forth are likely to accumulate in the irregularities. Further, large differences in height of the irregularities cause local abnormal discharge. Consequently, uniform charging is prevented, and the image defect such as white dots occurs.

As described above, the alternating current value (Iac1) to be applied to the charging roller 32 has been set such that the white dot disappearance margin is ensured at an initial stage after the start of the operation of the image forming apparatus 1. Further, the ten-point average surface roughness Rz of the surface layer 32*a* of the charging roller 32 has been set in the range from 3 μm to 12 μm in the manufacturing process of the charging roller 32 to suppress the local abnormal discharge due to the differences in height of the irregularities and reduce the image defect such as white dots.

Meanwhile, after the lapse of a predetermined time, the surface layer 32*a* of the charging roller 32 is abraded by the additive contained in the toner, and thus the ten-point average surface roughness Rz thereof is reduced. Therefore, the additive may adhere to the surface layer 32*a* (charging roller contamination) and cause, in a halftone image, for example, a reduction in density appearing as image streaks.

As a result of examination of the above-described issues, it has been revealed that it is possible to suppress white dots occurring in an image at an initial stage after the start of an operation of an image forming apparatus and prevent an image defect occurring after the lapse of time owing to contamination of a charging member, when a charging roller and a photoconductor drum of the image forming apparatus satisfies a relationship $0.005 \leq \Delta Rz/\Delta D \leq 0.8$. Herein, the charging roller includes a resistive elastic layer and a surface layer formed thereon. At the initial stage after the start of the operation, the surface layer has a ten-point average surface roughness Rz ranging from approximately 3 μm to approximately 6 μm, and the resistive elastic layer and the surface layer have an impedance ratio of approximately 0.81 or less in absolute value in a frequency range from approximately 800 Hz to approximately 3000 Hz. After the lapse of a predetermined time, the ten-point average surface roughness Rz of the surface layer is reduced by a decrement ΔRz ranging from approximately 0.1 μm to approximately 4 μm. Further, the photoconductor drum has a film thickness D ranging from approximately 20 μm to approximately 40 μm at the initial stage after the start of the operation, and reduced by a decrement ΔD ranging from approximately 5 μm to approximately 25 μm after the lapse of the predetermined time. Herein, the impedance ratio is represented as ZE/(ZE+ZS), in which ZE and ZS represent the impedance of the resistive elastic layer and the impedance of the surface layer, respectively. Further, the predetermined time corresponds to a time taken to print 100k A4-size recording media recorded with line images having a width of approximately 1.5 mm with an area coverage of approximately 7%.

(2.3) Method of Measuring Impedance

Figure 4:
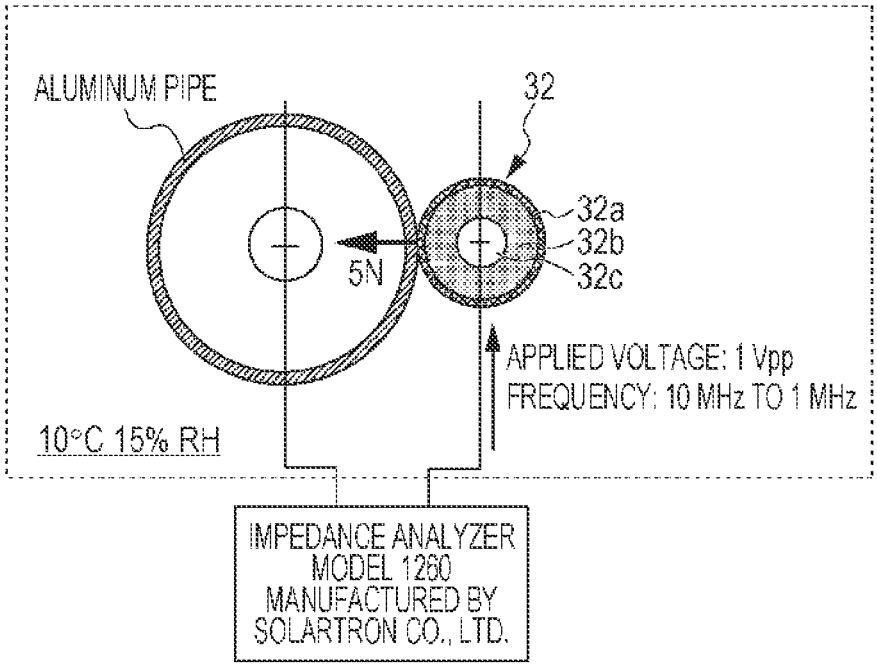
FIG. 4 is a diagram illustrating an example of a measurement configuration that measures the impedance.

FIG. 4 is a diagram illustrating an example of a measurement configuration that measures the impedance. With reference to the drawing, description will be given below of a method of measuring the impedance ZE of a resistive elastic layer 32*b* of the charging roller 32 and the impedance ZS of the surface layer 32*a*. In the measurement of the impedance, an impedance analyzer, a frequency analyzer, or the like capable of measuring the frequency in a range from 0.1 Hz to 1 MHz, such as an impedance analyzer Model 1260 manufactured by Solartron Co., Ltd., for example, is employed as a measuring device.

The impedance is measured in a stationary state in which the charging roller 32 is brought into contact with and pressed against an aluminum pipe (metal conductor) having a diameter of 30 mm and a surface roughness Rmax of 1.6 μm or less (with pressing force of 5 N applied on one side of the pipe in each measurement) under a similar condition to that of the image forming apparatus 1 in which the charging roller 32 is used. Specifically, since the white dots are likely to occur in a low-temperature, low-humidity environment, the impedance is measured in an environment with a temperature of 10° C. and a humidity of 15 RH % to control physical properties of the charging roller 32, while an alternating-current voltage of 1 Vpp is applied to the charging roller 32 with the frequency changed in a range from 1 MHz to 10 MHz in descending order.

Figure 5:
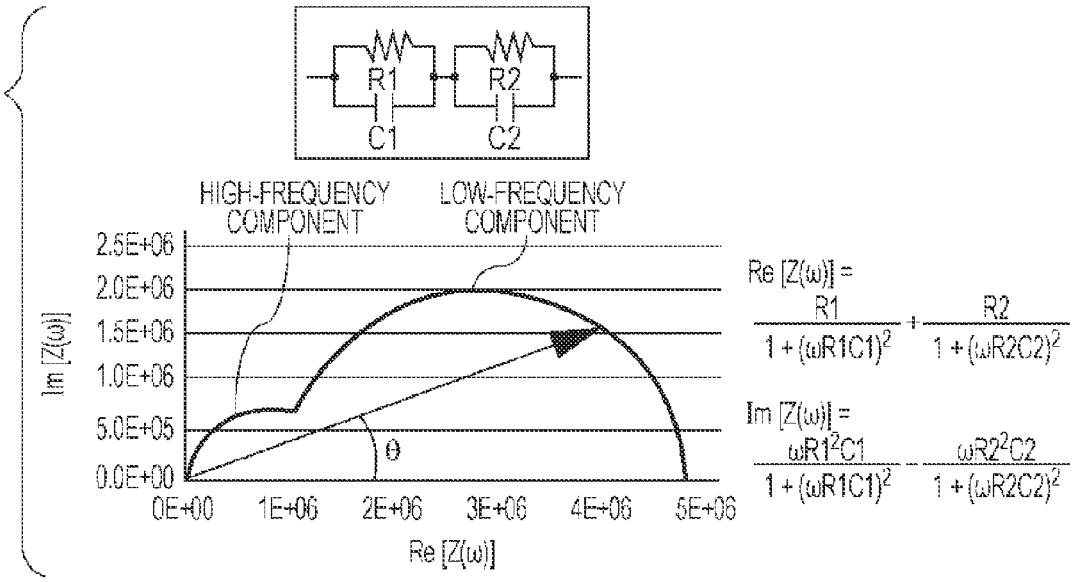
FIG. 5 is a diagram illustrating an example of a Cole-Cole plot (Nyquist diagram) based on the measurement of the impedance.

As illustrated in FIG. 5, in the measurement of the impedance, a real-part impedance Re[Z(ω)] and an imaginary-part impedance Im[Z(ω)] are obtained at each of the frequencies. In an equivalent circuit in which a resistance R and an electrostatic capacitance C are connected in parallel, a semicircular curve having a center located on the axis of the real-part impedance Re[Z(ω)] and a diameter corresponding to the value of the resistance R is plotted by a constant determining method called Cole-Cole method with the value Re[Z(ω)]−Im[Z(ω)]. Accordingly, it is possible to measure an RC constant of the charging roller 32 in a nondestructive manner. The fitting of the curve may be executed by the Instant Fit function of analysis software ZView2 developed by Solartron Co., Ltd.

It is possible to approximate the charging roller 32, in accordance with the layer structure thereof, with an equivalent circuit model in which the resistance R and the electrostatic capacitance C of each of the layers are connected in parallel and the resistance-capacitance combinations of the layers are connected in series (see FIG. 5). Herein, a bonding layer has little influence on electrical characteristics, and thus is not taken into account. If the bonding layer has influence on electrical characteristics, the bonding layer may be taken into account.

According to the results of changes in formation and single-layer measurements, the resistive elastic layer 32*b* is higher in natural frequency than the surface layer 32*a*, and it is possible to determine the RC constants of the respective layers from semicircular shapes for respective frequency bands according to a Cole-Cole plot (Nyquist diagram). Consequently, a resistance RE and an electrostatic capacitance CE of the resistive elastic layer 32*b* and a resistance RS and an electrostatic capacitance CS of the surface layer 32*a* are obtained.

(2.4) Calculation of Impedance

Figure 6:
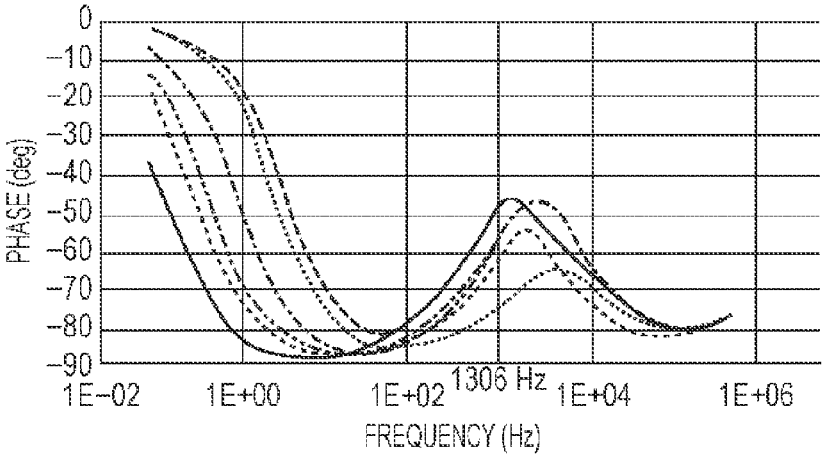
FIG. 6 is a diagram illustrating an example of a graph plotting the phase difference between an applied voltage and a response current relative to the frequency of the applied voltage.

The impedance is expressed by two parameters, i.e., the amplitude ratio of the response current to the applied voltage (1 Vpp) and the phase between the applied voltage (1 Vpp) and the response current. The frequency for maximizing a phase θ is obtained from the phase between the applied voltage and the response current relative to the frequency of the applied voltage (1 Vpp). Meanwhile, as illustrated in FIG. 6, in the phase of the charging roller 32 having two natural frequencies in a low-frequency band and a high-frequency band, two phase peaks are present in the low-frequency band and the high-frequency band (in the low-frequency band, a phase asymptotic to 0 degrees is referred to as a peak). Thus, the same phase value appears at plural frequencies. If the phase θ is used as a characteristic value, therefore, the white dot disappearance margin is not uniquely determined.

Therefore, the impedance ratio is defined as a characteristic value capable of uniquely controlling the white dot disappearance margin. Thereby, the degree of loss due to the impedance ZE and the impedance ZS relative to the impedance of the entire charging roller 32 is quantitatively and uniquely expressed. Herein, the impedance ZE corresponds to the combined resistance of the resistance RE of the resistive elastic layer 32*b* and the electrostatic capacitance CE of the resistive elastic layer 32*b*. Further, the impedance ZS corresponds to the combined resistance of the resistance RS of the surface layer 32*a* and the electrostatic capacitance CS of the surface layer 32*a*.

The impedance is calculated for each of the layers, i.e., the impedance ZE of the resistive elastic layer 32*b* and the impedance ZS of the surface layer 32*a*. The impedance of each of the layers is represented as R/(1+jωRC) (j represents an imaginary unit). The impedance ratio is represented by the absolute value of ZE/(ZE+ZS). That is, the impedance ratio is configured as the value resulting from dividing the loss impedance occurring in the frequency range of the applied voltage by the impedance of the entire charging roller 32.

Embodiment Example: The present invention will be more specifically described below on the basis of an embodiment example and a comparative example. The present invention, however, is not limited to the following embodiment example.

Manufacturing of Charging Roller

FIG. 7A illustrates basic formulations of the embodiment example and the comparative example. A polymer (epichlorohydrin rubber) illustrated in FIG. 7A is masticated for three minutes by a 12-inch open roll. Thereafter, carbon black, calcium carbonate, and an ion conductive agent are gradually added to the polymer during the rotation of the open roll. Finally, a vulcanizing agent and a vulcanization accelerator are mixed into the polymer, and the mixture is kneaded for five minutes to produce crude rubber for the resistive elastic layer 32*b*. Thereafter, the crude rubber is injected into a die by an injection molding machine, left to stand for three minutes, and removed from the die. The die used herein is a cylindrical die for injection molding having an inner diameter of 14.5 mm. A conductive core 32*c* is set in the die kept at a temperature of 170° C.±5° C. by a heater. After the molding of the roller, the roller is finished to an outer diameter of 14 mm by the use of a traverse grinder to obtain an elastic roller. In this process, the roller is finished to 6 μm in ten-point average surface roughness Rz specified in Japanese Industrial Standard (JIS) B0601 (1982), with the outer diameter of the roller set to be greater in a central portion than in end portions by approximately 55 μm (a crown shape).

Then, the elastic roller having the outer diameter finished by grinding is immersed in a surface layer forming liquid, which is produced with nylon particles having an average particle diameter of 5 μm added as a filler by the parts by mass illustrated in FIG. 7A to 100 parts by mass of solid content of the conductive liquid as the material of the surface layer 32*a*. Thereafter, the roller is lifted out of the liquid at a constant speed to dip-coat the roller with the surface layer forming liquid in an average film thickness of 9 μm. Then, the surface layer forming liquid is dried and baked, and the surface of the surface layer-formed elastic roller is ground by a grinder to form flat potions in convex portions of irregularities of the surface layer 32*a*. Thereby, the charging rollers 32 of the respective examples are obtained.

The produced charging rollers 32 of the embodiment example and the comparative example are subjected to the measurement of the impedance ZE of the resistive elastic layer 32*b* and the impedance ZS of the surface layer 32*a* by the measurement configuration illustrated in FIG. 4. With the use of an impedance analyzer Model 1260 manufactured by Solartron Co., Ltd., the impedance is measured in a stationary state in which the charging roller 32 is brought into contact with and pressed against one side of an aluminum pipe (metal conductor) having a diameter of 30 mm and a surface roughness Rmax of 1.6 μm or less with pressing force of 5 N in each measurement. Specifically, the impedance is measured in an environment with a temperature of 10° C. and a humidity of 15 RH %, while an alternating-current voltage of 1 Vpp is applied to the charging roller 32 with the frequency changed in a range from 1 MHz to 10 MHz in descending order.

FIG. 7B illustrates the resistance RE and the electrostatic capacitance CE of the resistive elastic layer 32*b*, the resistance RS and the electrostatic capacitance CS of the surface layer 32*a*, and the ten-point average surface roughness Rz of the surface layer 32*a* of the produced charging roller 32 of the embodiment example.

Embodiment Example: The evaluation of white dots is performed by the following evaluation method on an image forming apparatus 1 that includes charging rollers 32 each including a surface layer 32*a* having a ten-point average surface roughness Rz of 4.8 μm, a resistance RS of $3.6\times10^{6}$ Ω/m, and an electrostatic capacitance CS of $2.2\times10^{-9}$ F/m and a resistive elastic layer 32*b* having a resistance RE of $6.0\times10^{4}$ Ω/m and an electrostatic capacitance CE of $3.5\times10^{-10}$ F/m, photoconductor drums 31 each having an initial film thickness D of 32 μm, and a developer containing an additive ($SiO_2$) having a volume average particle diameter of 110 nm and a circularity of 0.774.

A halftone image is formed with a halftone dot area ratio of 50% in a low-temperature, low-humidity environment (a temperature of 10° C. and a humidity of 15 RH %) with an alternating-current voltage (Vac) of 1.7 kVpp and a direct-current voltage (Vdc) of 700 Vdc applied to the charging rollers 32. Then, the number of white dots occurring in the halftone image is counted. The result is favorable with a small number of white dots occurring in the image at the initial stage after the start of the operation.

Then, a print test is conducted with a run length of 13, in which line images having a width of 1.5 mm are recorded on A4-size recording media with an area coverage of 7%. Then, image streaks occurring in the processing direction owing to the adhesion of the additive to the surface layer 32*a* of the charging roller 32 are evaluated. Run length refers to the value representing the average number of prints made by one print command issued to the image forming apparatus 1. For example, a run length of 1 indicates that one print on average is made by one print command issued to the image forming apparatus 1, and a run length of 10 indicates that ten prints on average are made by one print command issued to the image forming apparatus 1.

After the rotation of the photoconductor drums 31 by 400k rotation cycles, the result is favorable with the occurrence of image streaks in the processing direction not visually recognized. Further, at this time, the evaluation of white dots is also performed similarly to the above-described method, and the result is favorable with a small number of white dots occurring in the image. At this time, the surface layer 32*a* of the charging roller 32 is abraded to a ten-point average surface roughness Rz of 3.0 μm, and the photoconductor drum 31 is abraded to a film thickness D of 22 μm (ΔRz=1.5 μm, ΔD=10 μm, and ΔRz/ΔD=0.15).

Comparative Example

Evaluations similar to those of the embodiment example are performed on an image forming apparatus 1 including charging rollers 32 each having a surface layer 32*a* having a ten-point average surface roughness Rz of 10.4 μm, a resistance RS of $1.6\times10^{9}$ Ω/m, and an electrostatic capacitance CS of $2.3\times10^{-9}$ F/m and a resistive elastic layer 32*b* having a resistance RE of $1.4\times10^{5}$ Ω/m and an electrostatic capacitance CE of $3.5\times10^{-10}$ F/m, photoconductor drums 31 each having an initial film thickness D of 32 μm, and a developer containing an additive ($SiO_2$) having a volume average particle diameter of 110 nm and a circularity of 0.774.

The result of evaluation of white dots is favorable at the initial stage after the start of the operation and after the lapse of time, with a small number of white dots occurring in a halftone image formed with a halftone dot area ratio of 50%. Meanwhile, the evaluation of image streaks occurring in the processing direction owing to the adhesion of the additive to the surface layer 32*a* of the charging roller 32 after the lapse of a predetermined time is worse as compared with that of the embodiment example (ΔRz=1.5 μm, ΔD=10 μm, and ΔRz/ΔD=0.15).

Figure 8:
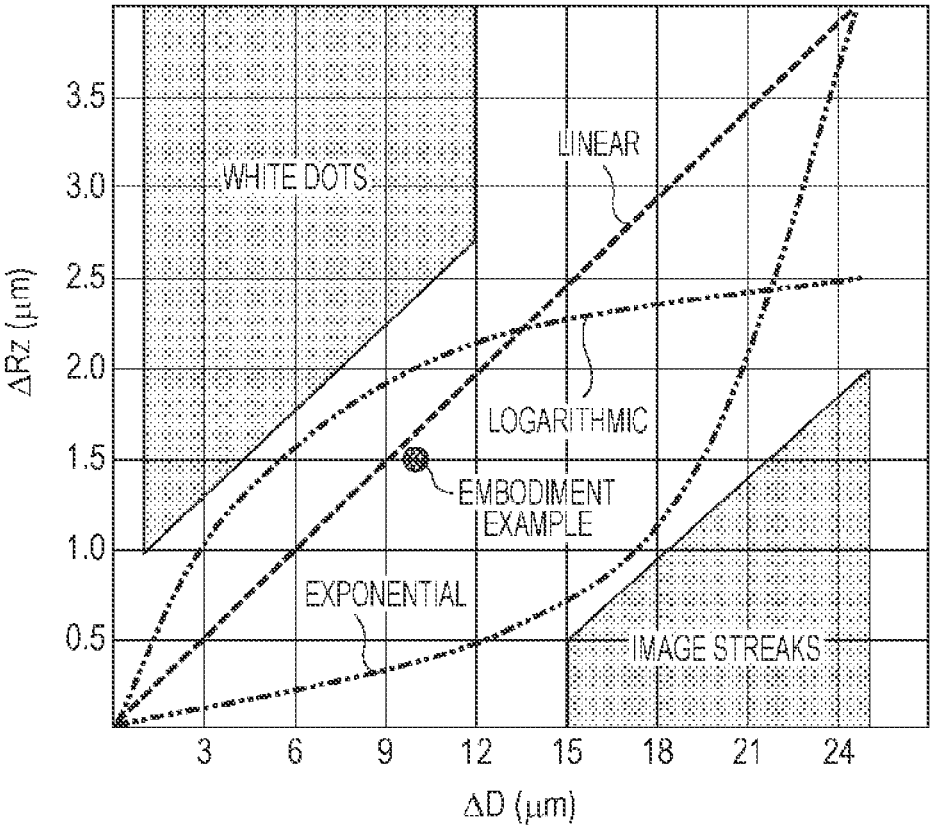
FIG. 8 is a diagram illustrating the relationship between a decrement in film thickness of the photoconductor drum and a decrement in ten-point average surface roughness Rz of a surface layer of the charging roller.

FIG. 8 illustrates the relationship between the decrement ΔD of the film thickness D of the photoconductor 31 and the decrement ΔRz of the ten-point average surface roughness Rz of the surface layer 32*a* of the charging roller 32. There are different patterns of change in the ratio between the decrement ΔRz of the ten-point average surface roughness Rz of the surface layer 32*a* of the charging roller 32 and the decrement ΔD of the film thickness D of the photoconductor 31 relative to the change in film thickness D of the photoconductor drum 31, i.e., a pattern in which the surface layer 32*a* of the charging roller 32 is more likely to be abraded at the initial stage (logarithmic), a pattern in which the surface layer 32*a* is less likely to be abraded at the initial stage and is more likely to be abraded over time (exponential), and a pattern in which the surface layer 32*a* is substantially constantly abraded from the initial stage (linear).

Particularly in the present embodiment example, in which the developer contains fine grinding particles, the surface layer 32*a* of the charging roller 32 is likely to be abraded. Thus, the ratio between the decrement ΔRz of the ten-point average surface roughness Rz of the surface layer 32*a* of the charging roller 32 and the decrement ΔD of the film thickness D of the photoconductor 31 tends to change logarithmically. A publicly known grinding agent may be employed as the fine grinding particles to be added. Fine inorganic particles superior in grinding performance include, for example, a variety of inorganic oxides, nitrides, and borides, such as cerium oxide, alumina, silica, titania, zirconia, barium titanate, aluminum titanate, strontium titanate, magnesium titanate, zinc oxide, chromium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The white dots are likely to occur in the image forming apparatus 1 having the ratio between the decrement ΔRz and the decrement ΔD located outside relational expressions of the above-described patterns in a region in which the change in film thickness D of the photoconductor 31 is small. The image streaks in the processing direction due to the adhesion of the additive to the surface layer 32*a* of the charging roller 32 are likely to occur in the image forming apparatus 1 having the ratio between the decrement ΔRz and the decrement ΔD located outside the relational expressions of the above-described patterns in a region in which the change in film thickness D of the photoconductor 31 become large (over time).

In the present exemplary embodiment, the image forming apparatus 1 is a so-called tandem-type image forming apparatus. The image forming apparatus 1, however, is not limited thereto. Further, in the above description, the image forming apparatus 1 is a color image forming apparatus including plural developing devices. The present invention, however, is not limited thereto, and is also applicable to a monochrome image forming apparatus, for example.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a charging roller that includes a resistive elastic layer and a surface layer formed thereon, the surface layer having a ten-point average surface roughness Rz ranging from approximately 3 μm to approximately 6 μm and the resistive elastic layer and the surface layer having an impedance ratio of approximately 0.81 or less in absolute value in a frequency range from approximately 800 Hz to approximately 3000 Hz at an initial stage after the start of an operation of the image forming apparatus, and the ten-point average surface roughness Rz of the surface layer reduced by a decrement ΔRz ranging from approximately 0.1 μm to approximately 4 μm after the lapse of a predetermined time; and a photoconductor drum that has a film thickness D ranging from approximately 20 μm to approximately 40 μm at the initial stage after the start of the operation, and reduced by a decrement ΔD ranging from approximately 5 μm to approximately 25 μm after the lapse of the predetermined time, wherein a relationship $0.005 \leq \Delta Rz/\Delta D \leq 0.8$ holds, and wherein the impedance ratio is represented as ZE/(ZE+ZS) in which ZE and ZS represent the impedance of the resistive elastic layer and the impedance of the surface layer, respectively, and the predetermined time corresponds to a time taken to print 100k A4-size recording media recorded with images with an area coverage of approximately 7%.

2. The image forming apparatus according to claim 1, further comprising:

a developing device that includes a developer containing fine inorganic particles having a volume average particle diameter ranging from approximately 100 nm to approximately 300 nm and a circularity ranging from approximately 0.7 to approximately 1.0.

3. The image forming apparatus according to claim 1, wherein the developer contains fine grinding particles.

4. The image forming apparatus according to claim 2, wherein the developer contains fine grinding particles.

5. The image forming apparatus according to claim 1, wherein the change in value ΔRz/ΔD relative to the number of rotation cycles of the photoconductor drum is linear.

6. The image forming apparatus according to claim 2, wherein the change in value ΔRz/ΔD relative to the number of rotation cycles of the photoconductor drum is linear.

7. The image forming apparatus according to claim 3, wherein the change in value ΔRz/ΔD relative to the number of rotation cycles of the photoconductor drum is linear.

8. The image forming apparatus according to claim 4, wherein the change in value ΔRz/ΔD relative to the number of rotation cycles of the photoconductor drum is linear.

9. The image forming apparatus according to claim 1, wherein the change in value ΔRz/ΔD relative to the number of rotation cycles of the photoconductor drum is exponential.

10. The image forming apparatus according to claim 2, wherein the change in value ΔRz/ΔD relative to the number of rotation cycles of the photoconductor drum is exponential.

11. The image forming apparatus according to claim 3, wherein the change in value ΔRz/ΔD relative to the number of rotation cycles of the photoconductor drum is exponential.

12. The image forming apparatus according to claim 4, wherein the change in value ΔRz/ΔD relative to the number of rotation cycles of the photoconductor drum is exponential.

13. The image forming apparatus according to claim 1, wherein the change in value ΔRz/ΔD relative to the number of rotation cycles of the photoconductor drum is logarithmic.

14. The image forming apparatus according to claim 2, wherein the change in value ΔRz/ΔD relative to the number of rotation cycles of the photoconductor drum is logarithmic.

15. The image forming apparatus according to claim 3, wherein the change in value ΔRz/ΔD relative to the number of rotation cycles of the photoconductor drum is logarithmic.

16. The image forming apparatus according to claim 4, wherein the change in value ΔRz/ΔD relative to the number of rotation cycles of the photoconductor drum is logarithmic.

* * * * *